US006691709B2

(12) United States Patent
Cynn

(10) Patent No.: US 6,691,709 B2
(45) Date of Patent: Feb. 17, 2004

(54) AIDING APPARATUS FOR SEXUALLY HANDICAPPED PERSON

(76) Inventor: Kie-Ho Cynn, 101-1107, Ilsin Mujigae Apartment, Sohol-Eub, Pocheon-Gun, Gyeonggi-Do 487-824 (KR)

( * ) Notice: Subject to any disclaimer, the term of this patent is extended or adjusted under 35 U.S.C. 154(b) by 214 days.

(21) Appl. No.: 10/024,817

(22) Filed: Dec. 19, 2001

(65) Prior Publication Data

US 2003/0111082 A1 Jun. 19, 2003

(51) Int. Cl.[7] ..... A61G 15/00
(52) U.S. Cl. ..... 128/845; 600/38; 5/657
(58) Field of Search ..... 128/842, 844, 128/845, 846, 918; 600/38; 5/657

(56) References Cited

U.S. PATENT DOCUMENTS

| | | | | | |
|---|---|---|---|---|---|
| 5,875,779 | A | * | 3/1999 | Fuhrman et al. | 128/845 |
| 6,030,039 | A | * | 2/2000 | Essler | 600/38 |
| 6,368,268 | B1 | * | 4/2002 | Sandvick et al. | 600/38 |
| 2003/0036678 | A1 | * | 2/2003 | Abbussi | 600/38 |
| 2003/0075958 | A1 | * | 4/2003 | Yogore | 297/245 |
| 2003/0111876 | A1 | * | 6/2003 | Black | 297/179 |
| 2003/0126686 | A1 | * | 7/2003 | Nash | 5/657 |

* cited by examiner

*Primary Examiner*—Michael A. Brown
(74) *Attorney, Agent, or Firm*—Lee, Hong, Degerman, Kang & Schmadeka

(57) ABSTRACT

The present invention relates to an aiding apparatus for treating sexually handicapped persons, which apparatus may be of a big help to conjugal life of sexually handicapped persons. The present invention proposes an aiding apparatus for treating sexually handicapped persons comprising: a frame (10) including opposite supporting structures (12) each provided with a multi-stage rack (11), a plurality of horizontal connecting bars (13) connecting the supporting structures; a bench (20) disposed in the central area of the frame (10), so that the front and rear ends of the bench can be adjusted in the height and inclination; first and second height adjusting members (30) and (40) installed respectively on a front and rear connecting bars (13) for liftably supporting the front and rear parts of the bench (20); a camera mounting bar (50) disposed in front of and under the bench (20) so as to be pivotable laterally; a camera (C) mounted on the camera mounting bar (50) for photographing the area of the bench (20); monitor mounting bars (60) disposed respectively on the opposite supporting structures so as to be pivotable laterally; and monitors (M) mounted on the monitor mounting bars (60) for displaying the images photographed by the camera (C).

5 Claims, 7 Drawing Sheets

AIDING APPARATUS FOR SEXUALLY HANDICAPPED PERSON

FIELD OF THE INVENTION

The present invention relates to an aiding apparatus for treating sexually handicapped persons who find difficulty in conjugal life due to the physical defects.

BACKGROUND OF THE INVENTION

Generally, the sexually handicapped people who find difficulty in conjugality at normal physical posture, for example, due to physical defects including armless or legless disability or otherwise due to corpulence tend to lose the sexual desire itself from unsmooth matrimonial life and neglect the matrimonial life due to the difficulty in the activity itself.

Therefore, there is necessary a treatment that includes guiding an inappropriate conjugal posture to an appropriate one and encouraging positive desire, in order to be a help for the matrimonial life of sexually handicapped people.

Conventionally, because even sexually handicapped persons had conjugal acts on beds just the same as sexually normal people, they could hardly take or maintain the posture adapted for their physical conditions during the sexual acts. Further, positive inducement was not possible amidst the confirmation of optimized posture, with the result that the fundamental problem for sexually handicapped persons remained unsolved or uncured.

The known proposed sexual aiding devices as described in Korean unexamined patent publication 98-66175 and U.S. Pat. Nos. 5,921,914 and 5,103,810 which are mainly focused on males' erecting potency describe the measures to increase the same potency or to enable conjugal act in unerected state. However, these aiding devices are useless for the people having sexual problems because of their physical handicaps, because their problems do not lie in the erecting potency but lie in the difficulty in maintaining the proper physical posture permitting conjugality.

On the other hand, the U.S. Pat. No. 4,825,855 proposes an aiding apparatus including a rigid frame supported above a bed, an elongated panel of cloth, and cables suspending the cloth panel from the frame, wherein an opening near one end for genitalic exposure is at the lowest portion of the cloth panel. Such a device can aid a comfortable conjugality, with the male free of laboriousness posed in an upper position. This is also not relevant to the case under consideration.

SUMMARY OF THE INVENTION

The object of the present invention is to provide an aiding apparatus for treating sexually handicapped persons, by which apparatus the act of both persons can be guided to an appropriate state from an inappropriate one and which apparatus can thus allow the persons handicapped in matrimonial act due to the bodily defects to enjoy smooth matrimonial relation through positive incitement.

The above object is achieved according to a preferred aspect of the invention by an aiding apparatus for treating sexually handicapped persons, comprising: a frame including opposite supporting structures each provided with a multi-stage rack, a plurality of horizontal connecting bars connecting the supporting structures; a bench disposed in the central area of the frame, so that the front and rear ends of the bench can be adjusted in the height and inclination; first and second height adjusting members installed respectively on a front and rear connecting bars for liftably supporting the front and rear parts of the bench; a camera mounting bar disposed in front of and under the bench so as to be pivotable laterally; a camera mounted on the camera mounting bar for photographing the area of the bench; monitor mounting bars disposed respectively on the opposite supporting structures so as to be pivotable laterally; and monitors mounted on the monitor mounting bars for displaying the images photographed by the camera.

DETAILED DESCRIPTION OF THE INVENTION

Figure 1:
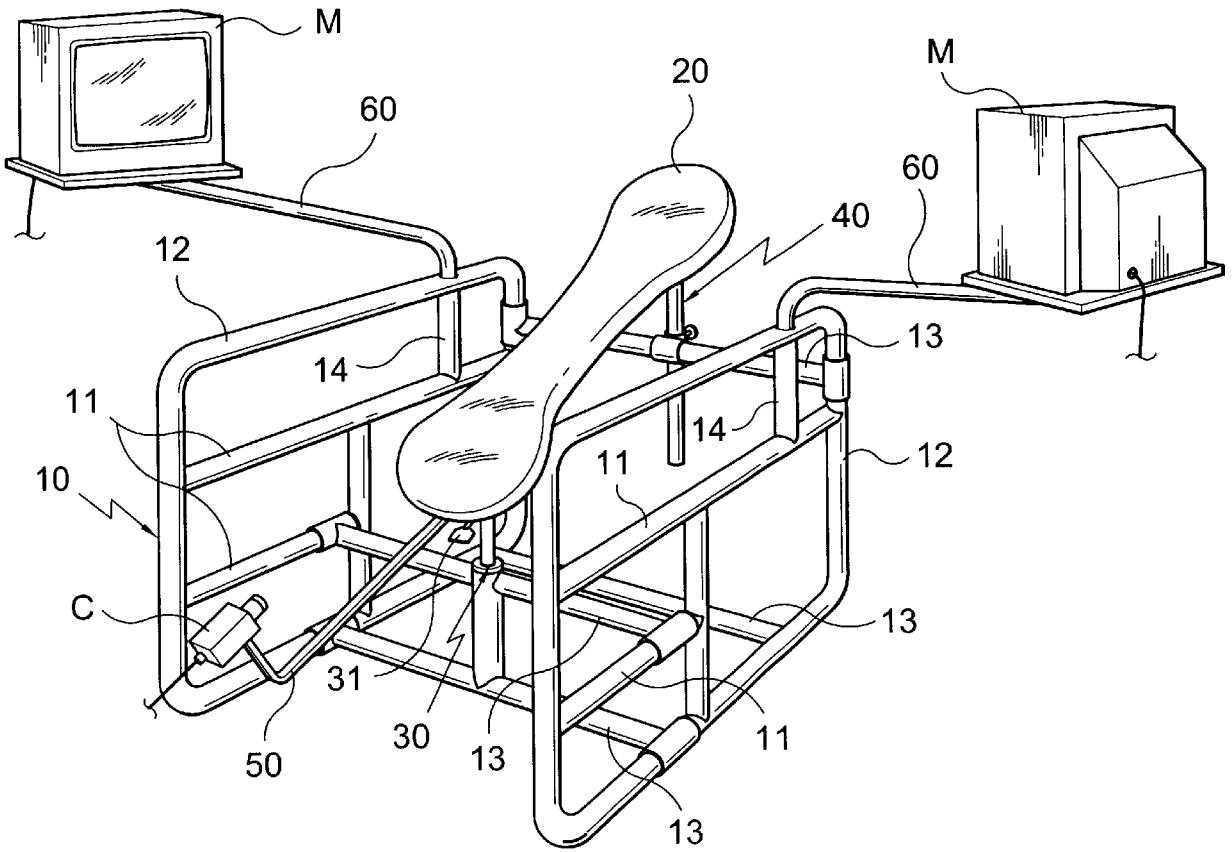
FIG. 1 shows a perspective view of the apparatus according to the invention.
Figure 2:
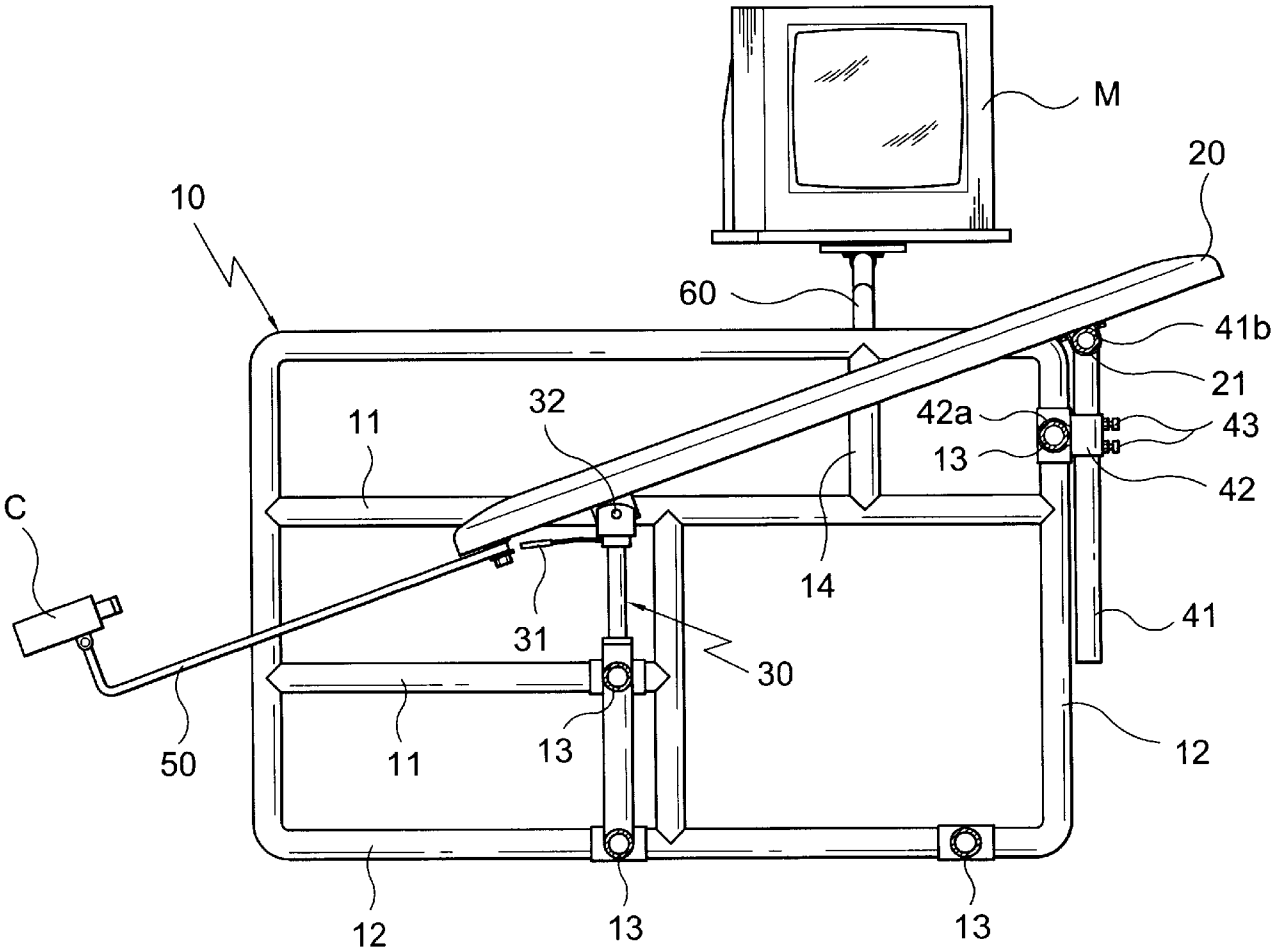
FIG. 2 shows an elevational view in cross section of the apparatus according to the invention.
Figure 3:
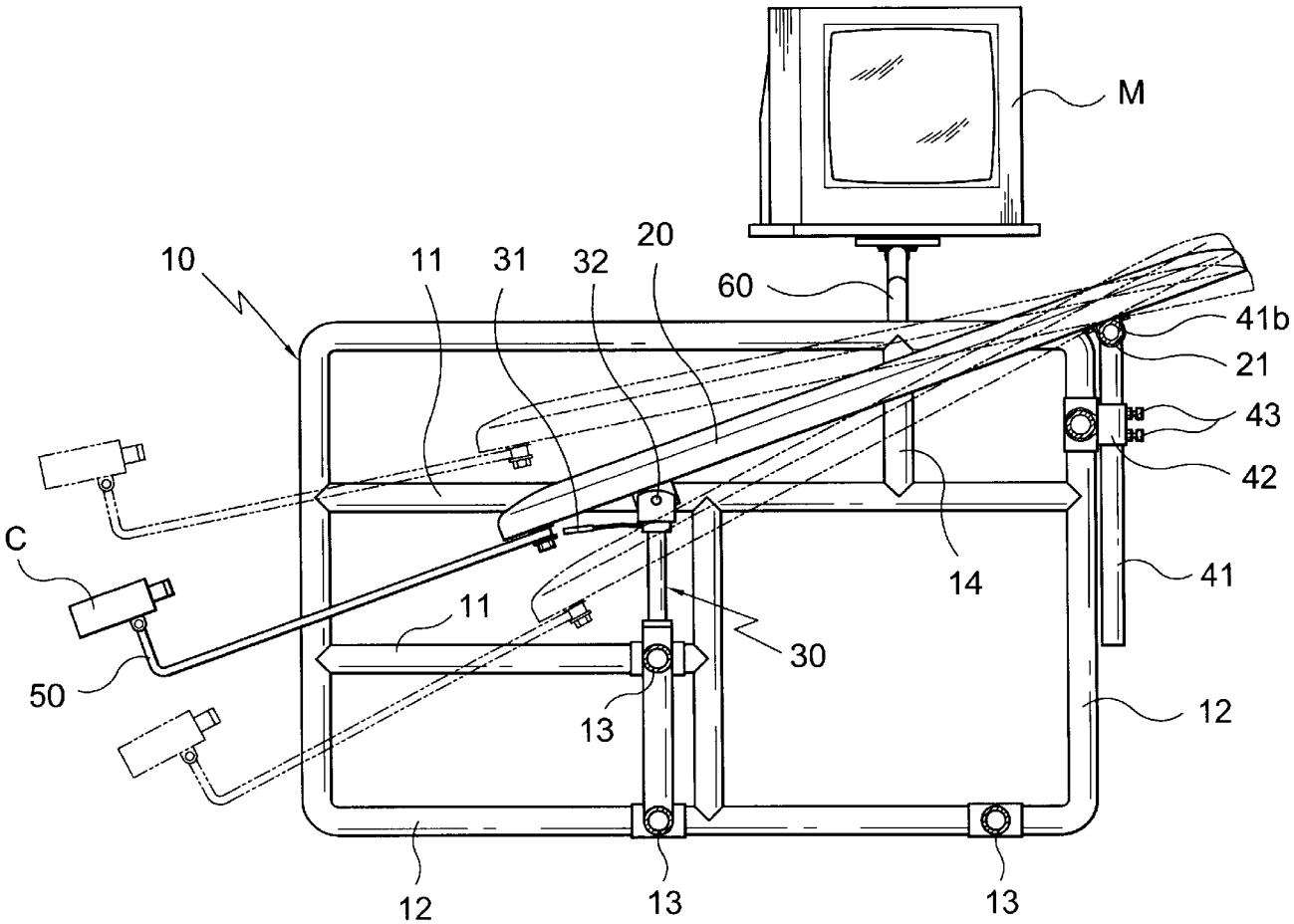
FIG. 3 shows an elevational view in cross section of the apparatus according to the invention, illustrating the operation of the bench.

A preferred embodiment of the invention is described in detail below by referring to the accompanying drawings.

The aiding apparatus for treating sexually handicapped persons according to the invention comprises, as shown in FIGS. 1 to 6, a frame 10 including opposite supporting structures 12 each provided with a multi-stage rack 11, a plurality of horizontal connecting bars 13 connecting the supporting structures; a bench 20 disposed in the central area of the frame 10, so that the front and rear ends of the bench can be adjusted in the height and inclination; first and second height adjusting members 30 and 40 installed respectively on a front and rear connecting bars 13 for liftably supporting the front and rear parts of the bench 20; a camera mounting bar 50 disposed in front of and under the bench 20 so as to be pivotable laterally; a camera C mounted on the camera mounting bar 50 for photographing the area of the bench 20; monitor mounting bars 60 disposed respectively on the opposite supporting structures so as to be pivotable laterally; and monitors M mounted on the monitor mounting bars 60 for displaying the images photographed by the camera C.

The supporting structures 12 constituting the frame 10 are each formed of a rectangular piping framework in which several pipes run longitudinally to form the rack 11. Such multi-stage racks 11 and both supporting structures 12 function to help the users in assuming suitable posture by having their hands, feet, legs and the like relying thereon dependent on their physical conditions during their conjugality.

Accordingly, even sexually handicapped person or persons can easily maintain a physical posture enabling conjugality in accordance with the degree of handicap, because they can take suitable postures, with their hands, feet or legs lying or supported on the multi-stage racks 11 and both supporting structures 12 constructed as described above.

On the rear top position of each of the opposite supporting structures 12 there is formed a mounting hole 12*a* for receiving the monitor mounting bar 60, below which mounting hole a supporting pipe 14 is vertically connected to support the monitor mounting bar 60 pivotably.

The bench 20, which is installed on the first and second height adjusting members 30 and 40 so as to be adjustable in its height and angle, helps the users to take suitable postures for conjugality, as the bench 20 can be freely adjusted in its height and inclination angle at its front and rear ends.

The first height adjusting member 30 can consist of, for example, an ordinary hydraulic cylinder which is adjusted in its height by an adjusting lever 31. This member 30 is connected to the bench 20 through a hinge 32 at a position below the front part of the bench 20.

Figure 4A:
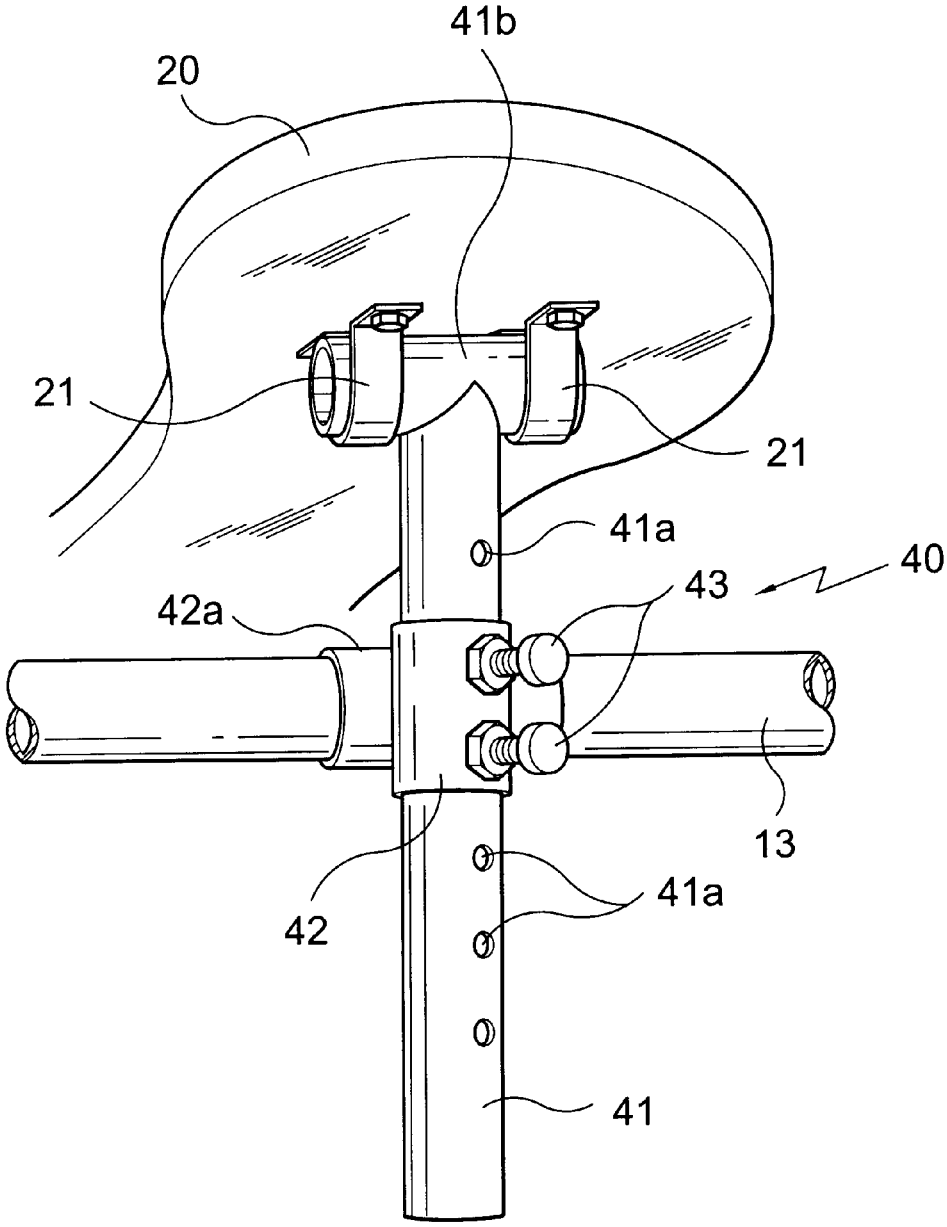
FIGS. 4*a* and 4*b* show the perspective and side cross sectional views of the second height adjusting member.
Figure 4B:
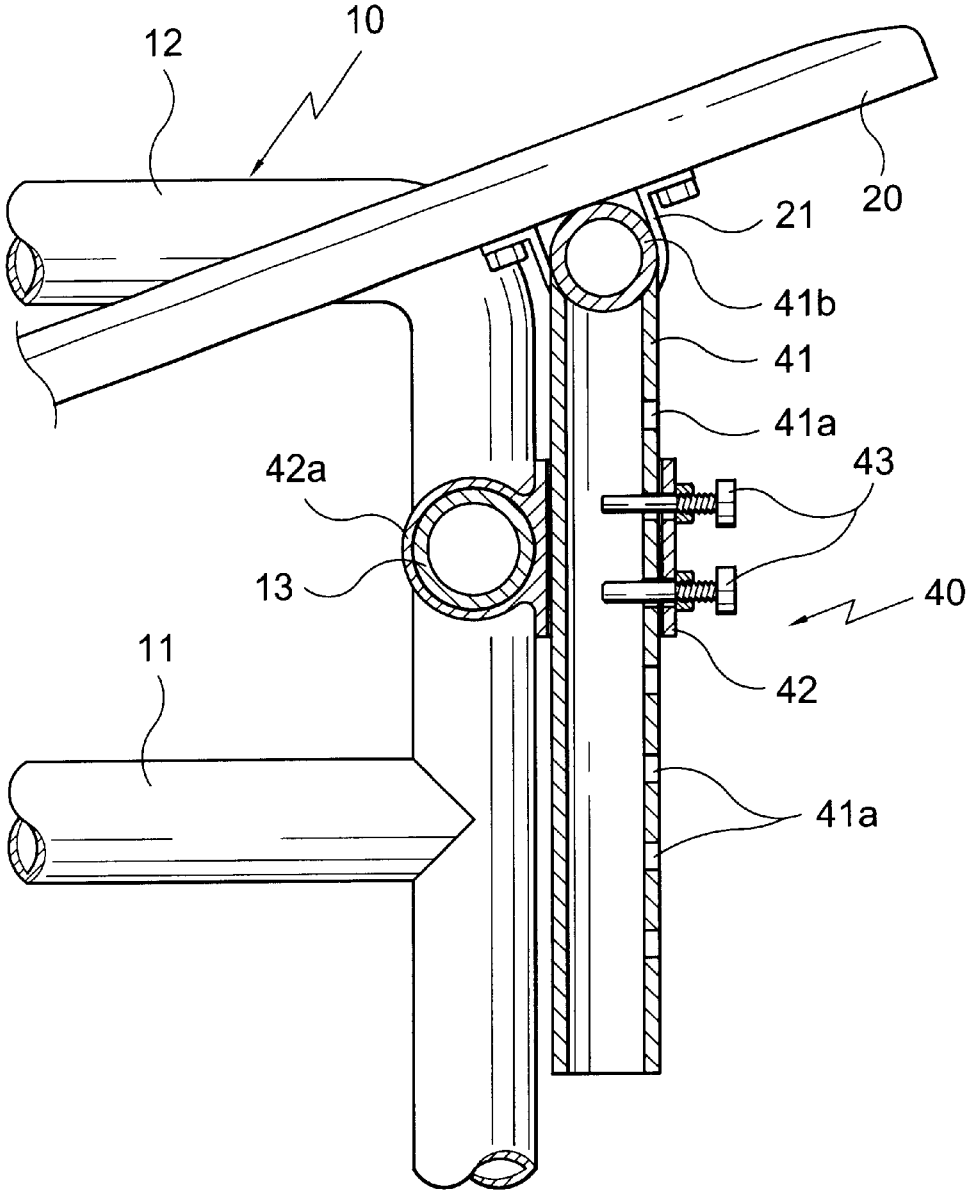

The second height adjusting member 40 consists of an adjusting pipe 41 connected pivotally to the bench 20 at the rear underside thereof and formed with a number of adjusting holes 41*a,* the holes being lined vertically at a fixed interval, a short supporting pipe 42 fixed to a connecting bar 13 of the frame 10 for supporting the adjusting pipe 41 in a movable manner and lock bolts 43 provided with the supporting pipe 42 to be fitted in adjusting holes 41*a,* as best seen in FIG. 4*a*.

Further, an axle pipe 41*b* is provided integrally on the top of the adjusting pipe 41, brackets 21 are fixed to the rear underside of the bench 20 to retain the axle pipe 41*b* in a pivotal manner and the supporting pipe 42 is integrally connected to a fixing pipe 42*a* through which a connecting bar 13 is inserted fixedly.

Figure 5A:
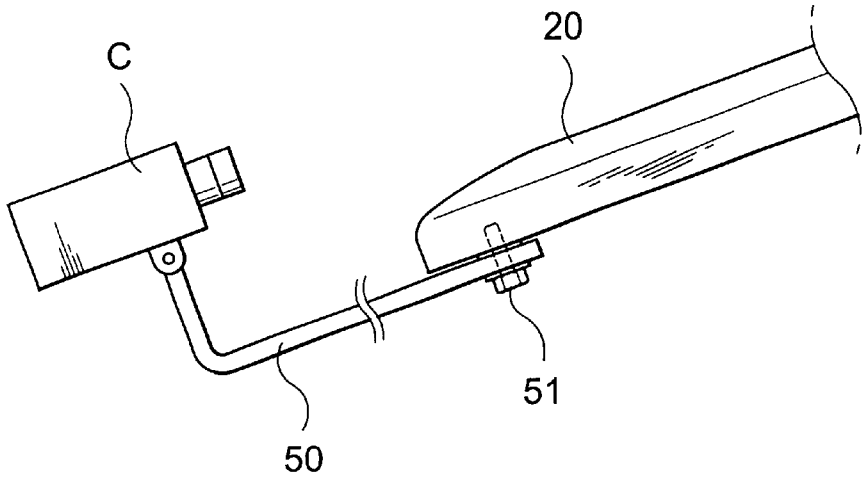
FIGS. 5*a* and 5*b* show the perspective and underside views for illustrating the connection structure of the camera mounting bar.
Figure 5B:
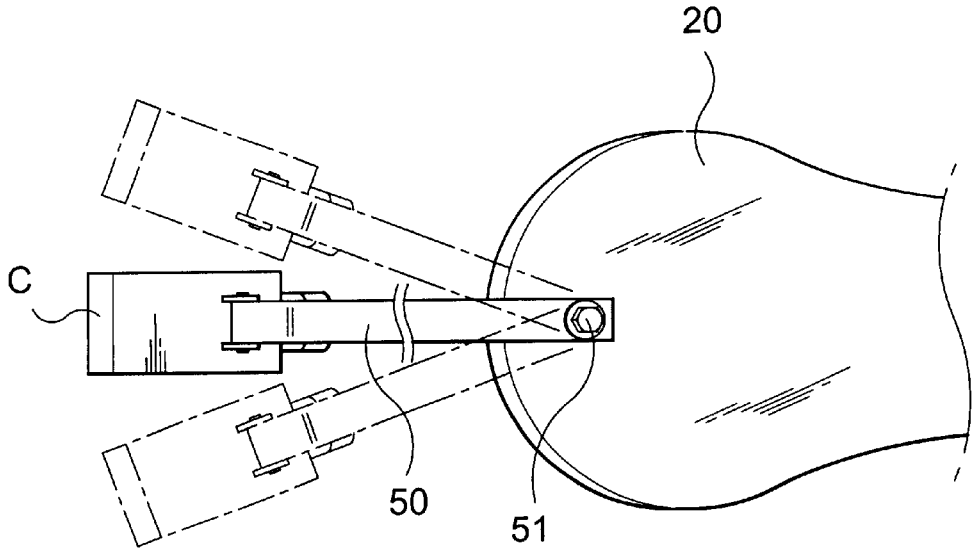

The camera mounting bar 50 is bent substantially at the right angle and its free end is connected pivotally to the front underside of the bench 20 through a bolt 51, as seen in FIG. 5*a*.

Figure 6:
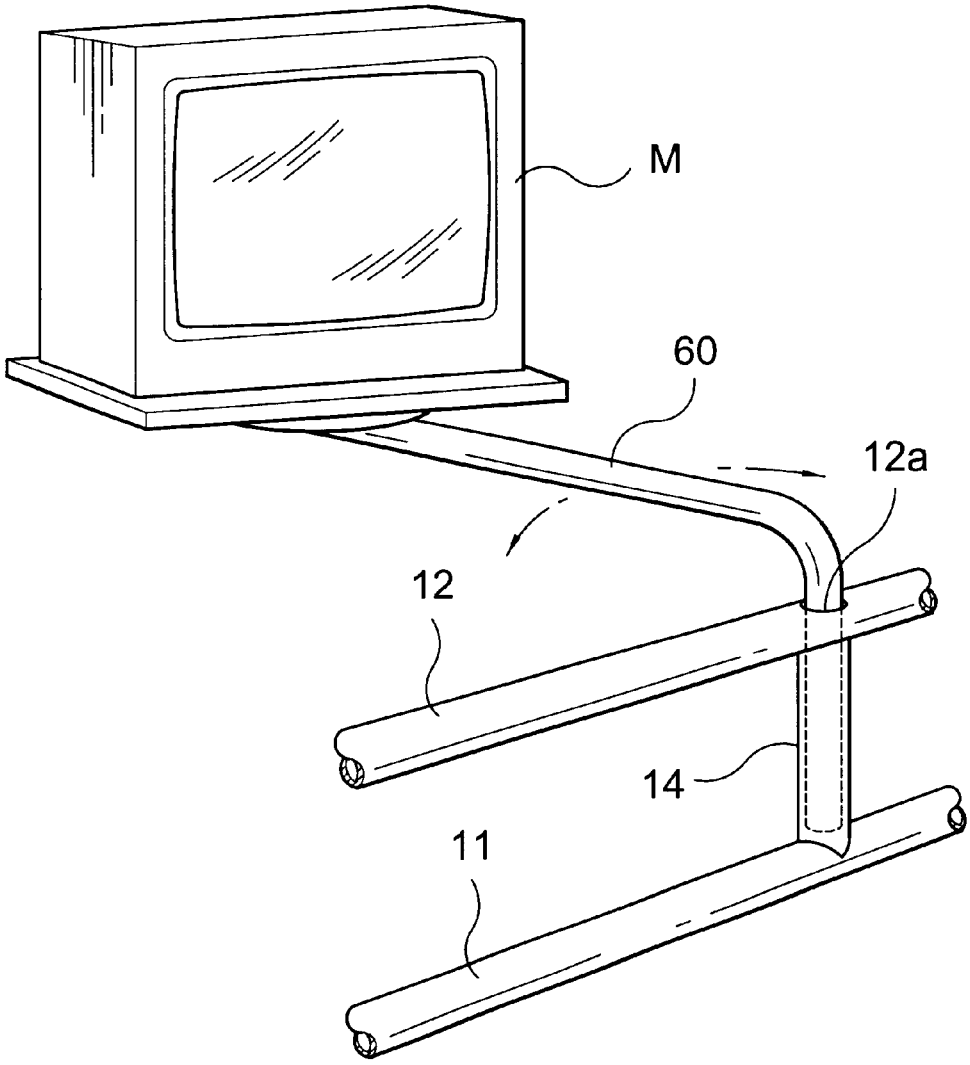
FIG. 6 shows the perspective view for illustrating the connection structure of the monitor mounting bar.

Each of the monitor mounting bars 60 is bent at an approximate right angle and its lower vertical section is fitted in the supporting pipe 14 rotatably after passing through the mounting hole 12*a* formed on a supporting structure 12, as clearly shown in FIG. 6.

The camera C and the monitors M are electrically connected, so that images photographed by the camera C are displayed on the screens of the monitors M. The camera C installed on the terminal top of the camera fixing bar 50 takes the picture of the posture of users, while the monitors M installed on the monitor fixing bars 60 play the role of monitoring so that the users can see their own postures. The reason for the installation of monitors is to guide the users to take proper postures and to enhance the positive desire of users.

In the operation of the apparatus according to the invention, first the height and angle at the front and rear location of the bench 20 are suitably adjusted by operating the first and second height adjusting members 30 and 40. At the same time, the locations of the camera C and monitors M are chosen by adjusting the camera fixing bar 50 and monitor fixing bars 60. Thereafter, the users can suspend their posture adapted for their physical conditions by taking advantage of the multi-stage racks 11 provided on the both supporting frames 12, while sitting or lying on the bench 20. In addition, the users can indulge more positively in conjugality, confirming the scene of their preferable physical position photographed by the camera C through the monitors M. At that time, the users maintain a preferable posture, with their hands, feet or legs depending on the racks 11 of the opposite supporting structures 12, as described above.

Accordingly, the present invention can contribute a great deal to the conjugal life of sexually handicapped people who have difficulty of connubiality on a normal physical posture, on the ground that with the help of the inventive apparatus, they can keep postures adapted for the physical condition, inducing positive interest on the confirmation of the desirable poses.

In addition, the inventive device can be used not only by the handicapped people but also by the normal people seeking for fortified sexual experience in various conjugal postures.

What is claimed is:

1. An aiding apparatus for treating sexually handicapped persons, comprising: a frame (10) including opposite supporting structures (12) each provided with a multi-stage rack (11), a plurality of horizontal connecting bars (13) connecting the supporting structures (12); a bench (20) disposed in the central area of the frame (10), so that the front and rear ends of the bench can be adjusted in the height and inclination; first and second height adjusting members (30) and (40) installed respectively on a front and rear connecting bars (13) for liftably supporting the front and rear parts of the bench (20); a camera mounting bar (50) disposed in front of and under the bench (20) so as to be pivotable laterally; a camera (C) mounted on the camera mounting bar (50) for photographing the area of the bench (20); monitor mounting bars (60) disposed respectively on the opposite supporting structures so as to be pivotable laterally; and monitors (M) mounted on the monitor mounting bars (60) for displaying the images photographed by the camera (C).

2. The aiding apparatus according to claim 1, wherein the supporting structures (12) are each formed of a rectangular piping framework in which plural pipes extend longitudinally to form the rack (11).

3. The aiding apparatus according to claim 2, wherein on a rear top position of each of the opposite supporting structures (12), there is formed a mounting hole (12*a*) for receiving the monitor mounting bar (60), wherein below the mounting hole (12*a*), a supporting pipe (14) is vertically connected to support the monitor mounting bar (60) pivotably.

4. The aiding apparatus according to claim 1, wherein the first height adjusting member (30) comprises an ordinary hydraulic cylinder which is adjusted in its height by an adjusting lever (31).

5. The aiding apparatus according to claim 1, wherein the second height adjusting member (40) comprises an adjusting pipe (41) connected pivotally to the bench (20) at the rear underside thereof and formed with a number of adjusting holes (41*a*), the holes being lined vertically at a fixed interval, a short supporting pipe (42) fixed to a connecting bar (13) of the frame (10) for supporting the adjusting pipe (41) in a movable manner and lock bolts (43) provided on the supporting pipe (42) so as to be fitted in adjusting holes (41*a*).

* * * * *